US006569314B1

(12) United States Patent
Iaccino et al.

(10) Patent No.: US 6,569,314 B1
(45) Date of Patent: May 27, 2003

(54) COUNTERCURRENT HYDROPROCESSING WITH TRICKLE BED PROCESSING OF VAPOR PRODUCT STREAM

(75) Inventors: Larry L. Iaccino, Friendswood, TX (US); Edward S. Ellis, Basking Ridge, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/457,435

(22) Filed: Dec. 7, 1999

Related U.S. Application Data

(60) Provisional application No. 60/111,332, filed on Dec. 7, 1998.

(51) Int. Cl.[7] ..... C01G 65/02; C01G 65/04; C01G 65/12

(52) U.S. Cl. ..... 208/58; 208/57; 208/210; 208/211; 208/212; 208/251 H; 208/254 H

(58) Field of Search ..... 208/57, 58, 210, 208/211, 212, 251 H, 254 H

(56) References Cited

U.S. PATENT DOCUMENTS

| | | | | |
|---|---|---|---|---|
| 2,952,626 A | | 9/1960 | Kelley et al. | 208/210 |
| 2,971,754 A | | 2/1961 | Seyfried | 266/5 |
| 2,987,467 A | | 6/1961 | Keith et al. | 208/97 |
| 3,017,345 A | | 1/1962 | Eastman et al. | 208/210 |
| 3,091,586 A | | 5/1963 | Pappas et al. | 208/210 |
| 3,124,526 A | | 3/1964 | Butler et al. | 208/264 |
| 3,147,210 A | | 9/1964 | Hass et al. | 208/210 |
| 3,186,935 A | * | 6/1965 | Vaell | 208/59 |
| 3,211,641 A | | 10/1965 | Halik et al. | 208/59 |
| 3,228,871 A | | 1/1966 | Schlinger et al. | 208/58 |
| 3,268,438 A | | 8/1966 | Scott, Jr. et al. | 208/89 |
| 3,413,216 A | | 11/1968 | Doumani | 208/216 |
| 3,415,737 A | | 12/1968 | Kluksdahl | 208/139 |
| 3,425,810 A | | 2/1969 | Scott, Jr. | 23/289 |
| 3,450,784 A | | 6/1969 | Reilly et al. | 260/667 |
| 3,461,063 A | | 8/1969 | Stine et al. | 208/143 |
| 3,595,779 A | | 7/1971 | Peck et al. | 208/210 |
| 3,607,723 A | | 9/1971 | Peck et al. | 208/59 |
| 3,658,681 A | | 4/1972 | Wilson et al. | 208/211 |
| 3,671,420 A | | 6/1972 | Wilson et al. | 208/61 |
| 3,673,078 A | | 6/1972 | Kirk, Jr. | 208/89 |
| 3,714,030 A | | 1/1973 | Winsor et al. | 208/210 |
| 3,767,562 A | | 10/1973 | Sze et al. | 208/57 |
| 3,775,291 A | | 11/1973 | Sze | 208/57 |
| 3,788,976 A | | 1/1974 | Kirk, Jr. | 208/89 |
| 3,843,508 A | | 10/1974 | Wilson et al. | 208/89 |
| 3,846,278 A | | 11/1974 | Sze et al. | 208/57 |
| 3,897,329 A | | 7/1975 | Franz et al. | 208/210 |
| 3,905,893 A | | 9/1975 | Christman et al. | 208/210 |
| 4,021,330 A | | 5/1977 | Satchell, Jr. | 208/89 |
| 4,022,682 A | | 5/1977 | Bludis et al. | 208/89 |

(List continued on next page.)

FOREIGN PATENT DOCUMENTS

| | | | |
|---|---|---|---|
| DE | 2935191 A1 | | 4/1981 |
| GB | 1323257 | | 7/1973 |
| GB | 2148937 A | * | 6/1985 |
| RU | 2016617 | | 7/1994 |

*Primary Examiner*—Walter D. Griffin
(74) *Attorney, Agent, or Firm*—Gerard J. Hughes; Erika Singleton Wilson

(57) ABSTRACT

The present invention relates to a process for upgrading a liquid petroleum or chemical stream wherein said stream flows countercurrent to the flow of a treat gas, such as a hydrogen-containing gas, in at least one reaction zone. At least a fraction of up flowing vapor product is condensed to produce a condensate comprised of the heavier fraction of the vapor phase product stream and a lighter remaining vapor stream. The condensate and potentially the lighter remaining vapor stream are further hydroprocessed.

11 Claims, 1 Drawing Sheet

U.S. PATENT DOCUMENTS

| | | | | | |
|---|---|---|---|---|---|
| 4,026,674 | A | | 5/1977 | McDonald | 23/283 |
| 4,194,964 | A | | 3/1980 | Chen et al. | 208/108 |
| 4,212,726 | A | | 7/1980 | Mayes | 208/101 |
| 4,213,847 | A | | 7/1980 | Chen et al. | 208/111 |
| 4,225,415 | A | * | 9/1980 | Mirza et al. | 208/403 |
| 4,243,519 | A | | 1/1981 | Schorfheide | 208/210 |
| 4,457,834 | A | | 7/1984 | Caspers et al. | 208/143 |
| 4,476,069 | A | | 10/1984 | Harper et al. | 261/97 |
| 4,526,757 | A | | 7/1985 | Gupta | 422/106 |
| 4,591,426 | A | | 5/1986 | Krasuk et al. | 208/96 |
| 4,599,162 | A | | 7/1986 | Yen | 208/59 |
| 4,624,748 | A | | 11/1986 | Haunschild | 203/29 |
| 4,755,281 | A | | 7/1988 | Penick | 208/108 |
| 4,801,373 | A | | 1/1989 | Corman et al. | 208/210 |
| 4,952,306 | A | | 8/1990 | Sawyer et al. | 208/216 |
| 5,026,459 | A | | 6/1991 | Quang et al. | 202/158 |
| 5,082,551 | A | | 1/1992 | Reynolds et al. | 208/100 |
| 5,183,556 | A | | 2/1993 | Reilly et al. | 208/57 |
| 5,252,198 | A | | 10/1993 | Harrison et al. | 208/208 R |
| 5,262,044 | A | | 11/1993 | Huizinga et al. | 208/107 |
| 5,292,428 | A | | 3/1994 | Harrison et al. | 208/208 R |
| 5,348,641 | A | | 9/1994 | Shih | 208/89 |
| 5,366,614 | A | | 11/1994 | Russ et al. | 208/65 |
| 5,378,348 | A | | 1/1995 | Davis et al. | 208/27 |
| 5,449,501 | A | | 9/1995 | Luebke et al. | 422/193 |
| 5,518,607 | A | | 5/1996 | Field et al. | 208/212 |
| 5,522,198 | A | | 6/1996 | Byer et al. | 52/741.3 |
| 5,522,983 | A | | 6/1996 | Cash et al. | 208/59 |
| 5,670,116 | A | | 9/1997 | Gupta et al. | 422/191 |
| 5,705,052 | A | | 1/1998 | Gupta | 208/57 |
| 5,720,872 | A | | 2/1998 | Gupta | 208/57 |
| 5,779,992 | A | | 7/1998 | Higashi | 422/190 |
| 5,882,505 | A | | 3/1999 | Wittenbrink et al. | 208/59 |
| 5,888,376 | A | | 3/1999 | Wittenbrink et al. | 208/59 |
| 5,888,377 | A | | 3/1999 | Bertram | 208/59 |
| 5,906,728 | A | | 5/1999 | Iaccino et al. | 208/61 |
| 5,925,235 | A | | 7/1999 | Habib | 208/111.35 |
| 5,939,031 | A | | 8/1999 | Ellis et al. | 422/191 |
| 5,942,197 | A | | 8/1999 | Gupta et al. | 422/191 |
| 5,985,131 | A | | 11/1999 | Gupta et al. | 208/57 |
| 6,007,787 | A | | 12/1999 | Gupta et al. | 422/191 |
| 6,017,443 | A | * | 1/2000 | Buchanan | 208/210 |
| 6,036,844 | A | * | 3/2000 | Gupta et al. | 208/49 |

* cited by examiner

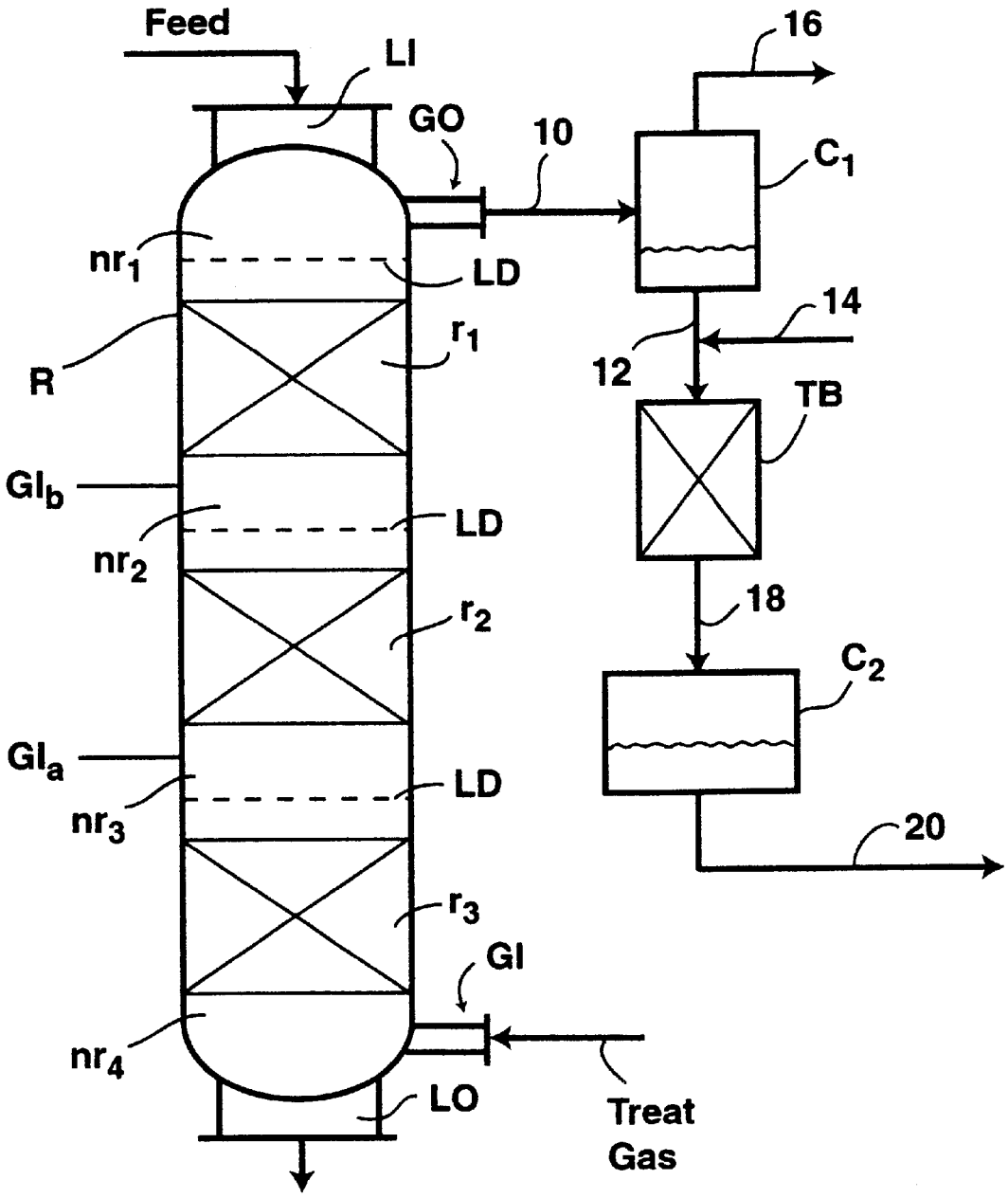
Feed
LI
GO
10
16
$C_1$
$nr_1$
LD
14
$r_1$
R
12
TB
$GI_b$
LD
$nr_2$
18
$r_2$
$C_2$
$GI_a$
LD
$nr_3$
20
$r_3$
GI
$nr_4$
LO
Treat
Gas

COUNTERCURRENT HYDROPROCESSING WITH TRICKLE BED PROCESSING OF VAPOR PRODUCT STREAM

CROSS-REFERENCE TO RELATED APPLICATIONS

This application claims the benefit of Provisional Application 60/111,332 filed on Dec. 7, 1998.

BACKGROUND OF THE DISCLOSURE

1. Field of the Invention

The present invention relates to a process for upgrading a liquid petroleum or chemical stream wherein said stream flows countercurrent to the flow of a treat gas, such as a hydrogen-containing gas, in at least one reaction zone. At least a fraction of up flowing vapor product is condensed to produce a condensate comprised of the heavier fraction of the vapor phase product stream and a lighter remaining vapor stream. The condensate and potentially the lighter remaining vapor stream are further hydroprocessed.

2. Background of the Invention

There is a continuing need in the petroleum refining and chemical industries for catalyst and process technology that result in increase yields of desirable products and lower yields of undesirable components, especially those related to environmental concerns. One such process technology, hydroprocessing, has been subjected to increasing demands for improved heteroatom removal, aromatic saturation, and boiling point reduction. More active catalysts and improved reaction vessel designs are needed to meet these demands. Countercurrent hydroprocessing, where the liquid feedstream flows counter to upflowing treat gas, has the potential of meeting some of these demands because they offer certain advantages over co-current process where the liquid feedstream and treat gas flow co-currently. Countercurrent hydroprocessing is well known, but it has never reached its commercial potential, primarily because of flooding problems. Within a countercurrent flow reactor the up flowing treat gas becomes saturated with reaction products and lighter components of the feed. Typical reaction products of consequence are $H_2S$, $NH_3$, $H_2O$, and light hydrocarbon products due to cracking, saturation, or heteroatom removal. These species increase the mass flux of the vapor phase thereby reducing the hydraulic capacity of a given diameter reactor; they also depress hydrogen partial pressure thereby reducing favorable reaction kinetics and thermodynamics. The condensable portions of these species present additional problems because as they move up the reactor into cooler or reduced treat gas (due to consumption) regimes they may condense increasing the down flowing liquid rate. This phenomenon can create a reflux loop within the reactor that can exceed the fresh feed rate. The refluxing is detrimental for two reasons: hydraulic capacity of the given reactor diameter is reduced and feed dilution results in less favorable reaction kinetics and thermodynamics.

A countercurrent process is disclosed in U.S. Pat. No. 3,147,210 that teaches a two-stage process for the hydroprocessing-hydrogenation of high boiling aromatic hydrocarbons. The feedstock is first subjected to catalytic hydroprocessing, preferably in co-current flow with a hydrogen-rich treat gas, then subjected to hydrogenation over a sulfur-sensitive noble metal hydrogenation catalyst countercurrent to the flow of a hydrogen-rich gas. U.S. Pat. Nos. 3,767,562 and 3,775,291 disclose a similar process for producing jet fuels, except the jet fuel is first hydrodesulfurized prior to two-stage hydrogenation. U.S. Pat. No. 5,183, 556 also discloses a two-stage concurrent-countercurrent process for hydrofining-hydrogenating aromatics in a diesel fuel stream. Any resulting vapor-phase reaction products are swept upwards by the upward-flowing treat gas. Such vapor-phase reaction products may include relatively low boiling hydrocarbons and heteroatom components, such as $H_2S$ and $NH_3$, as well as a heavy hydrocarbon tail gas. The heavier molecules in the vapor phase product of countercurrent hydroprocessing decrease its quality and make further hydroprocessing of the vapor phase product difficult.

Therefore, there still exists a need for improved countercurrent hydroprocessing reaction designs.

SUMMARY OF THE INVENTION

In accordance with the present invention there is provided a process for hydroprocessing a hydrocarbonaceous feedstream, which process comprises:

(a) introducing said feedstream into a reaction vessel upstream from at least one reaction zone and passing said feedstream through one or more reaction zones operated at hydroprocessing conditions, wherein each reaction zone contains a bed of hydroprocessing catalyst;

(b) introducing a hydrogen-containing treat gas at the bottom of said reaction vessel and passing it upward through at least one reaction zone countercurrent to the flow of liquid feedstream, thereby reacting with said feedstream in the presence of said hydroprocessing catalysts and resulting in a liquid phase product stream and a vapor phase product stream;

(c) passing the liquid phase product out of the bottom of said reaction vessels;

(d) removing the vapor phase product stream overhead of said reaction zones;

(e) condensing a portion of said vapor phase product stream to produce a liquid stream comprised of the higher boiling point fractions and a vapor stream comprised of hydrogen-containing treat gas and the lower boiling point fractions; and (f) passing said liquid phase stream with a hydrogen containing treat gas through a trickle bed reactor operated at hydroprocessing conditions and containing a hydroprocessing catalyst.

In a preferred embodiment of the present invention the hydrogen-containing treat gas in (f) is fresh hydrogen-containing treat gas.

In another preferred embodiment of the present invention the hydrogen-containing treat gas in (f) is the vapor stream of (e).

BRIEF DESCRIPTION OF THE FIGURE

The sole FIGURE hereof shows one preferred process configuration of the present invention.

DETAILED DESCRIPTION OF THE INVENTION

The practice of the present invention is applicable to all liquid-vapor countercurrent refinery and chemical processes. Feedstocks suitable for use in the practice of the present invention include those ranging from the naphtha boiling range to heavy feedstocks, such as gas oils and resids. Typically, the boiling range will be from about 40° C. to about 1000° C. Non-limiting examples of such heavy feedstocks include vacuum resid, atmospheric resid, vacuum gas oil (VGO), atmospheric gas oil (AGO), heavy atmospheric gas oil (HAGO), steam cracked gas oil (SCGO), deasphalted oil (DAO), and light cat cycle oil (LCCO).

Non-limiting examples of hydroprocessing processes which can be practiced by the present invention include the hydroconversion of heavy petroleum feedstocks to lower boiling products; the hydrocracking of distillate boiling range feedstocks; the hydrotreating of various petroleum feedstocks to remove heteroatoms, such as sulfur, nitrogen, and oxygen; the hydrogenation of aromatics; the hydroisomerization and/or catalytic dewaxing of waxes, particularly Fischer-Tropsch waxes; and demetallation of heavy streams. It is preferred that the countercurrent hydroprocessing of the present invention be one in which a hydrocarbon feedstock is hydrotreated and hydrogenated, more specifically when heteroatoms are removed and when at least a portion of the aromatic fraction of the feed is hydrogenated. It is also preferred that the process of the present invention be one that produces ultra low sulfur distillate fuels.

Unless otherwise stated herein, the terms "downstream" and "upstream" are with respect to the flow of liquid that will flow downward. Further, the vessels of the present invention need not be limited to catalytic chemical reactions, but can also be used in gas-liquid contacting towers such as those used for extraction or stripping. In such cases, no reaction is necessarily involved and the upward-moving gas contacts a downward-moving liquid, typically to achieve mass transfer between the two streams.

The feedstocks of the present invention are subjected to countercurrent hydroprocessing in at least one catalyst bed, or reaction zone, wherein feedstock flows countercurrent to the flow of a hydrogen-containing treat gas. Typically, the hydroprocessing unit used in the practice of the present invention will be comprised of one or more reaction zones wherein each reaction zone contains a suitable catalyst for the intended reaction and wherein each reaction zone is immediately preceded and followed by a non-reaction zone where products can be removed and/or feed or treat gas introduced. The non-reaction zone will typically be void (with respect to catalyst) horizontal cross section of the reaction vessel of suitable height, although it may contain inert packing material.

The process of the present invention can be better understood by a description of the process configuration shown in the FIGURE hereof. Miscellaneous reaction vessel internals, such as thermocouples, heat transfer devices etc. are not shown in the FIGURE for simplicity. The FIGURE thereof shows reaction vessel R which contains liquid inlet LI for receiving a feedstock to be treated, and a liquid outlet LO for removing liquid reaction product. There is also provided treat gas inlet GI and gas, or: vapor phase outlet GO. The reaction vessel contains three serially disposed reaction zones, $r_1$, $r_2$, and $r_3$. Each reaction zone is immediately preceded and immediately followed by a non-reaction zone, $nr_1$, $nr_2$, $nr_3$, and $nr_4$. The non-reaction zone is typically void of catalyst; that is, it will be an empty section in the vessel with respect to catalyst. Liquid distribution means LD can be situated above each reaction zone in order to more evenly distribute downflowing liquid to the next downstream reaction zone. Each reaction zone is comprised of a bed of catalyst suitable for the desired reaction. There is also provided with a first condensation zone $C_1$, a trickle bed reaction zone TB, and a second condensation zone $C_2$.

The process of present invention can be practiced in accordance with the FIGURE hereof by introducing the feedstock to be treated into liquid inlet LI of reaction vessel R. A suitable treat gas, such as a hydrogen-containing gas, is introduced via port GI into the reaction vessel countercurrent to the downward flow of the liquid feedstock. It is to be understood that the treat gas need not be introduced only at the bottom of the reaction vessel at GI, but may also be introduced into any one or more of the non-reaction zones, for example at $GI_a$ and/or $GI_b$. Treat gas can also be injected into any one or more of the catalyst beds. An advantage of introducing treat gas at various points in the reaction vessel is to control the temperature within the reaction vessel. For example, cold treat gas can be injected into the reaction vessel at various points to moderate any exothermic heat of reaction. It is also within the scope of this invention that all of the treat gas can be introduced at any one of the aforesaid points as long as at least a portion of it flows countercurrent to the flow of liquid in at least one reaction zone.

It is often desirable to further process the vapor phase product stream from countercurrent hydroprocessing, especially if it is a virgin stream. As previously mentioned above further processing the vapor phase product stream in a vapor phase reactor has various limitations. For example: (a) it is limited by heat capacity resulting in significant temperature rise; (b) all of the components have equally short residence time; and (c) any catalyst is subjected to poisoning from the $H_2S$, $NH_3$, $H_2S$, etc., produced in reactor. The limited heat capacity is particularly important if one wishes to conduct aromatic saturation or hydrocracking on the overhead stream.

Partial condensation of the overhead vapor phase product stream and further processing of the total vapor/condensate steam in a conventional down flow trickle bed reactor overcomes the first two limitations. Such a configuration allows moderation of heat rise and increases residence time of the heavier fractions of the overhead product stream since they are now liquid phase rather than gas phase. This configuration is advantageous when processing of the entire overhead stream is desired for additional heteroatom removal and particularly advantageous when hydrocracking or aromatic saturation is desired. Instead of using a heat exchanger to reduce the temperature, a cooler quench liquid could also be used to achieve a liquid phase.

Returning to the FIGURE hereof at least a portion of the vapor phase product stream is passed to condensation zone $C_1$ via line 10 thereby resulting in a condensate of heavier components and a lighter vapor phase stream which contains gaseous reaction products from the reaction zones, such as $H_2S$ and $NH_3$. The condensate is passed via line 12, with hydrogen-containing treat gas via line 14, to trickle bed reactor TB which contains a catalyst suitable for the intended reaction. The light vapor phase product is collected overhead via line 16. The product from the trickle bed reactor is passed via line 18 to a second condensation zone $C_2$ where the resulting condensate is collected via line 20 and the vapor phase fraction, which is the recovered hydrogen-containing treat gas is sent to a vapor recovery section or recycled to one or more reaction zones.

If there is a strong need to overcome limitations with respect to catalyst poisons, for example to use a noble metal containing catalyst, the condensation can be performed and only the liquid phase can be passed to the further hydroprocessing with fresh hydrogen supplied as the treat gas. Treat gas from this step could in some cases be cascaded back to the reactor.

The trickle bed process of the present invention does not preclude the combined use with an all vapor phase reactor. In fact, the use of a vapor phase reactor can be used to reduce sulfur and nitrogen prior to gas/liquid separation. This is desirable to reduce the heteroatom content of the liquid going to the sensitive catalyst.

The liquid product from the trickle bed reactor may be retained as a discrete product, blended with one or both of the products from the main countercurrent reactor, or re-introduced into the reactor for further processing and/or as a quench. Further processing of this material in the lower portions of the countercurrent reactor is particularly attractive if deep hydrocracking or deep aromatic saturation is desired.

The process of the present invention is operated at suitable temperatures and pressures for the desired reaction. For example, typical hydroprocessing temperatures will range from about 40° C. to about 450° C. at pressures from about 50 psig to about 3,000 psig, preferably 50 to 2,500 psig. The liquid feedstock passes downward through the catalyst bed of reaction zone $r_1$, where it reacts with the treat gas on the catalyst surface. Any resulting vapor-phase reaction products are swept upwards by the upward-flowing treat gas. Such vapor-phase reaction products may include relatively low boiling hydrocarbons and heteroatom components, such as $H_2S$ and $NH_3$. Any unreacted feedstocks, as well as liquid reaction product pass downwardly through each successive catalyst bed of each successive reaction zone $r_2$ and $r_3$. The FIGURE hereof shows an optional liquid distribution means LR that can be positioned above each catalyst bed (reaction zone). The type of liquid distribution tray used is not believed to limit the practice of the present invention and the reaction vessel may therefore employ any conventional distribution trays, such as sieve trays, bubble cap trays, etc. The liquid effluent exits the reaction vessel via port LO and vapor phase effluent exits via port GO.

Feedstocks treated by the practice of the present invention will most likely contain undesirable high levels of heteroatoms, such as sulfur and nitrogen species. In such cases, it will often be preferred that the first reaction zone be one in which the liquid feedstream flows co-current with a stream of hydrogen-containing treat gas through a bed, preferably a fixed-bed, of suitable hydrotreating catalyst. The term "hydrotreating" as used herein refers to processes wherein a hydrogen-containing treat gas is used in the presence of a catalyst that is primarily active for the removal of heteroatoms, such as sulfur, and nitrogen species with some hydrogenation of aromatics. The term "hydroprocessing" includes hydrotreating, as well as other processes that are primarily active toward the hydrogenation, hydrocracking, and hydroisomerization. Ring-opening, particularly of naphthenic rings, for purposes of this invention can also be included in the term "hydroprocessing". Hydrotreating catalysts suitable for use in the present invention are any conventional hydrotreating catalyst and includes those which are comprised of at least one Group VIII metal, preferably Fe, Co and Ni, more preferably Co and/or Ni, and most preferably Co, and at least one Group VI metal, preferably Mo and W, more preferably Mo, on a high surface area support material, preferably alumina. Other suitable hydrotreating catalysts include zeolitic catalysts, as well as noble metal catalysts where the noble metal is selected from Pd and Pt.

It is within the scope of the present invention that more than one type of hydrotreating catalyst be used, either in the same catalyst bed or in separate catalyst beds. The Group VIII metal is typically present in an amount ranging from about 2 to 20 wt. %, preferably from about 4 to 12%. The Group VI metal will typically be present in an amount ranging from about 5 to 50 wt. %, preferably from about 10 to 40 wt. %, and more preferably from about 20 to 30 wt. %. All metals weight percents are on support. By "on support" we mean that the percents are based on the weight of the support. For example, if the support were to weigh 100 g. then 20 wt. % Group VIII metal would mean that 20 g. of Group VIII metal was on the support. Typical hydrotreating temperatures range from about 100° C. to about 400° C. with pressures from about 50 psig to about 3,000 psig, preferably from about 50 psig to about 2,500 psig. If the feedstock contains relatively low levels of heteroatoms, then the co-current hydrotreating step may be eliminated and the feedstock passed directly to an aromatic saturation, hydrocracking, and/or ring-opening reaction zone.

For purposes of this invention, the term "hydrogen-containing treat gas" means a treat gas stream containing at least an effective amount of hydrogen for the intended reaction. The treat gas stream used herein will preferably contain at least about 50 vol. %, more preferably at least about 75 vol. % hydrogen. It is preferred that the hydrogen-containing treat gas be make-up hydrogen-rich gas, preferably substantially pure hydrogen.

In the case where the first reaction zone is a co-current hydrotreating reaction zone, the liquid effluent from said hydrotreating reaction zone will be passed to at least one downstream reaction zone where the liquid is passed through a bed of catalyst countercurrent to the flow of upflowing hydrogen-containing treat-gas. The most desirable reaction products resulting from hydroprocessing, preferably when gas oils are the feedstocks, are those containing reduced levels of sulfur and nitrogen species. Product streams containing paraffins, especially linear paraffins are often preferred over naphthenes, which are often preferred over aromatics. To achieve this, at least one downstream catalyst will be selected from the group consisting hydrotreating catalysts, hydrocracking catalysts, aromatic saturation catalysts, and ring-opening catalysts. If it is economically feasible to produce a product stream with high levels of paraffins, then the downstream zones will preferably include an aromatic saturation zone and a ring-opening zone.

If one of the downstream reaction zones is a hydrocracking zone, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. The zeolite cracking bases are sometimes referred to in the art as molecular sieves, and are generally composed of silica, alumina, and one or more exchangeable cations such as sodium, magnesium, calcium, rare earth metals, etc. Crystal pores of relatively uniform diameter between about 4 and 12 Angstroms further characterize them. It is preferred to use zeolites having a relatively high silica/alumina mole ratio greater than about 3, preferably greater than about 6. Suitable zeolites found in nature include mordenite, clinoptiliolite, ferrierite, dachiardite, chabazite, erionite, and faujasite. Suitable synthetic zeolites include the Beta, X, Y, and L crystal types, e.g., synthetic faujasite, mordenite, ZSM-5, MCM-22 and the larger pore varieties of the ZSM and MCM series. A particularly preferred zeolite is any member of the faujasite family, see Tracy et al. Proc. of the Royal Soc., 1996, Vol. 452, p813. It is to be understood that these zeolites may include demetallated zeolites that are understood to include significant pore volume in the mesopore range, i.e., 20 to 500 Angstroms. Non-limiting examples of Group VIII metals that may be used on the hydrocracking catalysts include iron cobalt, nickel, ruthenium, rhodium, palladium, osmium, iridium, and platinum. Preferred are platinum and palladium, with platinum being more preferred. The amount of Group VIII metal will range from about 0.05 wt. % to 30 wt. %, based on the total weight of the catalyst. If the metal is a Group VIII noble metal, it is preferred to use about 0.05 to about 2 wt. %. Hydrocracking conditions include temperatures from about 200° to 425° C., preferably from about 220° to 330° C., more preferably from about 245° to 315° C.; pressure of about 200 psig to about 3,000 psig; and liquid hourly space velocity from about 0.5 to 10 V/V/Hr, preferably from about 1 to 5 V/V/Hr.

Non-limiting examples of aromatic hydrogenation catalysts include nickel, cobalt-molybdenum, nickel-molybdenum, and nickel tungsten. Non-limiting examples of noble metal catalysts include those based on platinum and/or palladium, which is preferably supported on a suitable support material, typically a refractory oxide material such as alumina, silica, alumina-silica, kieselguhr, diatomaceous earth, magnesia, and zirconia. Zeolitic supports can also be used. Such catalysts are typically susceptible to sulfur and nitrogen poisoning. The aromatic saturation zone is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

The liquid phase in the reaction vessels used in the present invention will typically be the higher boiling point components of the feed. The vapor phase will typically be a mixture of hydrogen-containing treat gas, heteroatom impurities, and vaporized lower-boiling components in the fresh feed, as well as light products of hydroprocessing reactions, and a relatively heavy tail gas. The vapor phase in the catalyst bed of a countercurrent reaction zone will be swept upward with the upflowing hydrogen-containing treat-gas and collected, fractionated, or passed along for further processing. If the vapor phase effluent still requires further hydroprocessing, it can be passed to a vapor phase reaction zone containing additional hydroprocessing catalyst and subjected to suitable hydroprocessing conditions for further reaction. It is to be understood that all reaction zones can either be in the same vessel separated by non-reaction zones, or any can be in separate vessels. The non-reaction zones in the later case will typically be the transfer lines leading from one vessel to another. It is also within the scope of the present invention that a feedstock that already contains adequately low levels of heteroatoms be fed directly into a countercurrent hydroprocessing reaction zone for aromatic saturation and/or cracking. If a preprocessing step is performed to reduce the level of heteroatoms, the vapor and liquid can be disengaged and the liquid effluent directed to the top of a countercurrent reaction vessel. The vapor from the preprocessing step can be processed separately or combined with the vapor phase product from the reaction vessel of the present invention. The vapor phase product(s) may undergo further vapor phase hydroprocessing if greater reduction in heteroatom and aromatic species is desired or sent directly to a recovery system In an embodiment of the present invention, the feedstock can be introduced into a first reaction zone co-current to the flow of hydrogen-containing treat gas. A vapor phase effluent fraction can then be separated from the liquid phase effluent fraction between reaction zones. That is, in a non-reaction zone. The vapor phase effluent can be condensed and the resulting condensate recycled to one or more reaction zones and the remaining vapor fraction passed to additional hydrotreating, or collected, or further fractionated. In other embodiments of the present invention, vapor phase effluent and/or treat gas can be withdrawn or injected between any reaction zones.

The countercurrent contacting of liquid from an upstream reaction zone with upflowing treat gas strips dissolved $H_2S$ and $NH_3$ impurities from the effluent stream, thereby improving both the hydrogen partial pressure and the catalyst performance. The resulting final liquid product will contain a substantially lower level of heteroatoms and substantially more hydrogen then the original feedstock. This liquid product stream may be sent to downstream hydroprocessing or conversion processes.

What is claimed is:

1. A process for hydroprocessing a hydrocarbonaceous feedstream, which process comprises:

(a) introducing said feedstream into the top of a reaction vessel upstream from at least one reaction zone and passing said feedstream through one or more reaction zones operated at hydroprocessing conditions, wherein each reaction zone contains a bed of hydroprocessing catalyst;

(b) introducing a hydrogen-containing treat gas at the bottom of said reaction vessel and passing it upward through every at least one reaction zone countercurrent to the flow of said feedstream, thereby reacting with said feedstream in the presence of said hydroprocessing catalysts and resulting in a liquid phase product stream and a vapor phase product stream;

(c) passing the liquid phase product out of the bottom of said reaction vessels;

(d) removing the vapor phase product stream overhead of said reaction zones;

(e) condensing a portion of said vapor phase product stream to produce a liquid phase stream and a vapor stream comprised of gaseous reaction products; and (f) passing said liquid phase stream and hydrogen-containing treat gas through a trickle bed reactor operated at hydroprocessing conditions and containing a hydroprocessing catalyst.

2. The process of claim 1 wherein the hydrogen-containing treat gas in (f) is fresh hydrogen-containing treat gas.

3. The process of claim 1 wherein the hydrogen-containing treat gas in (f) is the vapor stream of (e).

4. The process of claim 1 wherein the hydroprocessing catalyst in at least one reaction zone is a hydrocracking catalyst comprised of a Group VIII metal on a zeolitic support.

5. The process of claim 4 wherein the Group VIII metal is a noble metal.

6. The process of claim 2 wherein the hydroprocessing catalyst of step (f) is an aromatic saturation catalyst.

7. The process of claim 1 wherein the condensation of step (e) is achieved by quenching said vapor phase product with a quench liquid.

8. The process of claim 1 wherein the feedstream has previously undergone hydroprocessing.

9. The process of claim 1 wherein the hydrocarbonaceous feedstream is a heavy feedstock selected from the group consisting of vacuum resid, atmospheric resid, vacuum gas oil, atmospheric gas oil, heavy atmospheric gas oil, steam cracked gas oil, desaphalted oil, and light cat cycle oil.

10. The process of claim 1 wherein the hydrocarbonaceous feedstock is a naphtha boiling range feedstock.

11. The process of claim 1 wherein the feedstock is a Fischer-Tropsch reactor product stream.

* * * * *